United States Patent [19]

Vandyke et al.

[11] Patent Number: 4,934,454

[45] Date of Patent: Jun. 19, 1990

[54] PRESSURE SEALED LAMINATED HEAT EXCHANGER

[75] Inventors: John M. Vandyke; Richard E. Walsh, both of Rockford, Ill.

[73] Assignee: Sundstrand Corporation, Rockford, Ill.

[21] Appl. No.: 236,195

[22] Filed: Aug. 25, 1988

[51] Int. Cl.[5] ..... F28F 3/00

[52] U.S. Cl. ..... 165/165; 165/164

[58] Field of Search ..... 165/164, 165

[56] References Cited

U.S. PATENT DOCUMENTS 2,656,159 7/1948 Holm et al. .
3,865,185 2/1975 Ostbo .
3,909,118 9/1975 Schmidt .
4,096,910 6/1978 Coffinberry et al. .
4,347,897 9/1982 Sumitomo et al. .
4,494,171 1/1985 Bland et al. .

*Primary Examiner*—Gerald A. Michalsky
*Attorney, Agent, or Firm*—Wood, Phillips, Mason, Recktenwald & VanSanten

[57] ABSTRACT

A pressure sealed, laminated fluid-to-fluid heat exchanger is disclosed herein. The heat exchanger includes a laminated stack of alternating orifice and spacer plates with the orientation of the spacer plates relative to the orifice plates defining first and second fluid paths. A low pressure fluid conduit is provided for connecting a low pressure fluid supply to one of the fluid paths. A high pressure shell houses the stack and includes inlet and outlet ports for a high pressure fluid. The high pressure fluid enters the shells and traverses the other fluid path and also places the stack under compression to aid the bonds between the spacer plates and the orifice plates.

9 Claims, 3 Drawing Sheets

PRESSURE SEALED LAMINATED HEAT EXCHANGER

FIELD OF THE INVENTION

This invention relates generally to a heat exchanger and more particularly to a pressure sealed laminated heat exchanger.

BACKGROUND OF THE INVENTION

Fluid-to-fluid heat exchangers have been used, for example, in an aircraft where jet fuel is used to cool oil. Difficulties result from such an application since the jet fuel is at a relatively high pressure.

One form of a fluid-to-fluid heat exchanger comprises a laminated heat exchanger having bonded alternating orifice plates and spacer plates. However, if one of the fluids is under high pressure, as above, tensile stresses are imposed on the bonds. Typically, the bonds are weak in tension. Thus, the heat exchanger can rupture along the bond lines, especially after numerous pressure and temperature cycles.

Certain heat exchangers, such as that disclosed in Ostbo U.S. Pat. No. 3,865,185, utilize a bolt to provide a compressive force on a series of orifice plates having O-rings therebetween. However, use of such O-rings requires that the structure be larger to provide sufficient heat transfer, and along with the bolts results in a heavier, more expensive heat exchanger. In an application such as an aircraft, where size and weight are critical, such constructions may be unacceptable.

The present invention is intended to overcome these and other problems associated with heat exchangers.

SUMMARY OF THE INVENTION

In accordance with the present invention, a fluid-to-fluid heat exchanger is provided in a shell so that a high pressure fluid exerts a compressive force on the heat exchanger stack to aid the bonds.

A typical embodiment of the invention achieves the foregoing with a laminated stack including a plurality of heat conducting orifice plates, each having a plurality of apertures therethrough. A plurality of spacer plates each has first and second sets of apertures therethrough. Each spacer plate is positioned between adjacent ones of the orifice plates in a laminated stack configuration, and is bonded on either side to the adjacent orifice plates so that the first and second sets of apertures are generally in a preselected alignment with selected ones of the orifice plate apertures to provide respective first and second fluid paths. The outermost of the spacer plates have an inlet aperture therethrough which is in fluid communication with the second set of apertures. The apertures of the outermost orifice plates are in alignment only with the spacer plate first set of apertures. A low pressure fluid conduit is provided in fluid communication with the inlet apertures for providing fluid flow through the second fluid path. A high pressure shell houses the stack. The shell has inlet and outlet means providing flow of fluid into and out of the housing and through the first fluid path. The pressure exerts a compressive force on the stack to aid the bonds between the spacer plates and the orifice plates.

The resulting construction eliminates the need for further bonding between the spacer plates and orifice plates due to the fact that the stack is in a net compressive force. Thus, the system is lighter in weight and smaller in size, as well as less expensive.

In one embodiment of the invention, low pressure fluid enters and exits the heat exchanger through conduits which are in communication with the inlet apertures of opposite end spacer plates.

In another embodiment of the invention, the apertures of each adjacent orifice plate are offset from one another and are of such a size to provide jet impingement on each subsequent orifice plate in the fluid path.

In yet another embodiment of the invention, the end spacer plates are of a larger thickness than the other spacer plates to facilitate the passage of fluid through the second fluid path.

In still another embodiment of the invention, the orifice plates and spacer plates are of aluminum construction and are brazed to one another to provide the bonds therebetween.

Other advantages of the invention will become apparent from the following specification taken in connection with the accompanying drawings.

DESCRIPTION OF THE INVENTION

Figure 2:
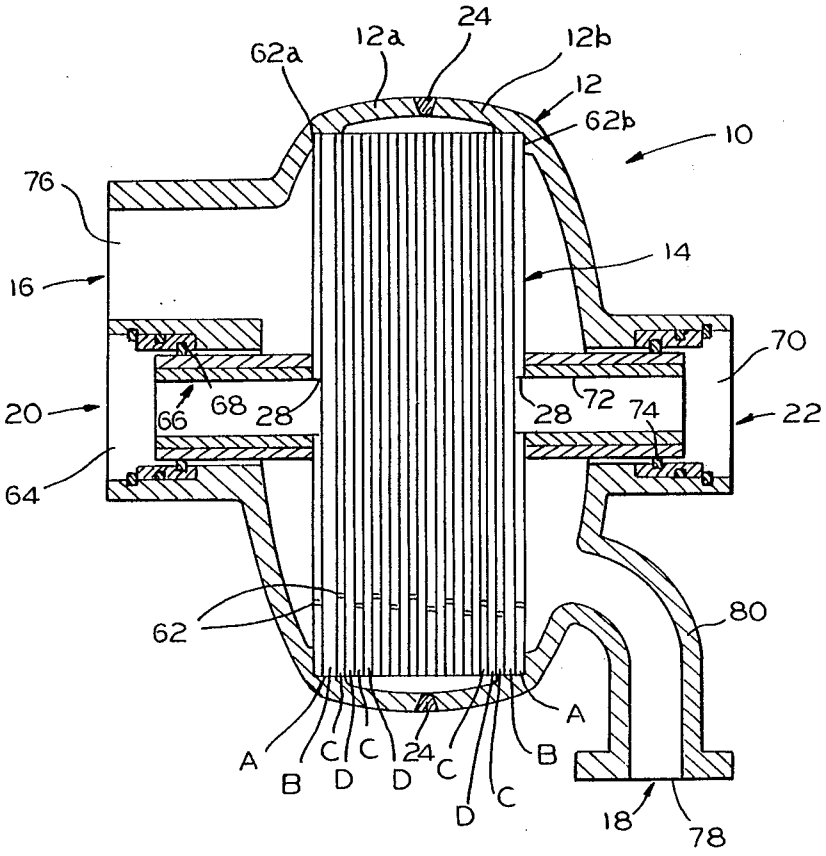
FIG. 2 is a sectional view taken along the line 2—2 of FIG. 1.
Figure 1:
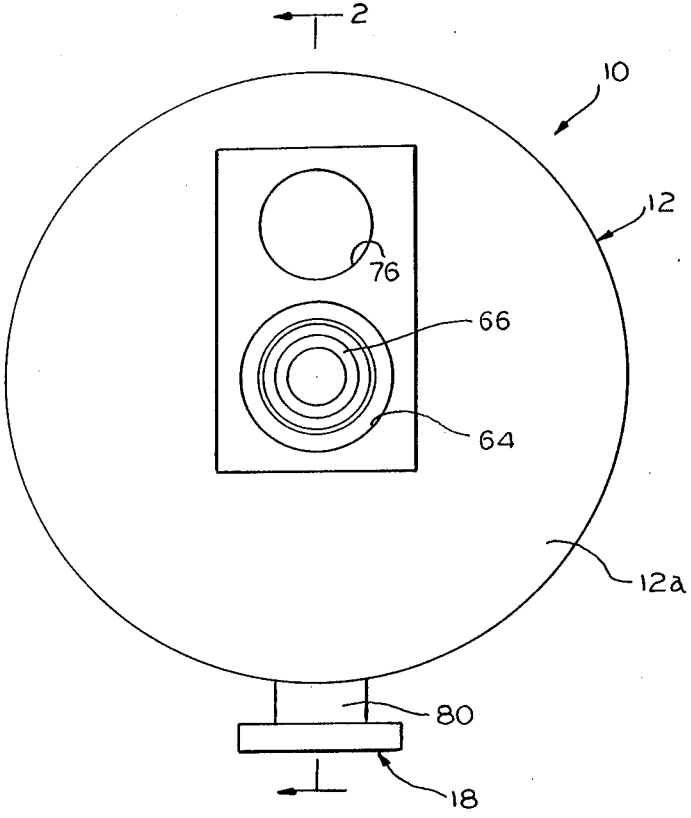
FIG. 1 is an end elevation view of a heat exchanger according to the invention.

An exemplary embodiment of a heat exchanger 10 according to the invention is illustrated in FIGS. 1 and 2 of the drawings. The heat exchanger 10 is a fluid-to-fluid heat exchanger which is operable to provide heat transfer between a relatively high pressure fluid and a relatively low pressure fluid.

The heat exchanger 10 includes a shell 12, a heat exchanger stack 14, a high pressure inlet port 16, a high pressure outlet port 18, a low pressure inlet port 20, and a low pressure outlet port 22.

The shell 12 is generally cylindrical in shape and is of two piece construction having two shell halves **12*a* and 12*b* joined as by a weld 24. Alternatively, the shell halves 12*a* and 12*b* could be connected by bolts or the like. The shell 12** must be able to withstand high pressure such as might be encountered when the high pressure fluid is jet aircraft fuel being pumped to an engine.

The stack 14 is a lamination of alternating orifice plates and spacer plates. Opposite outermost end plates A comprise end orifice plates particularly illustrated in FIG. 3. Immediately inwardly of the end orifice plates A are end spacer plates B, illustrated in FIG. 5. Between the end spacer plates B is a series of alternating inner orifice plates C and inner spacer plates D. In the illustrated embodiment, the arrangement of plates is as in the following series:

ABCDCDCDCDCDCDCDCDCDCAB

As will be appreciated, the exact number of plates utilized can be varied according to the desired heat transfer.

Figure 3:
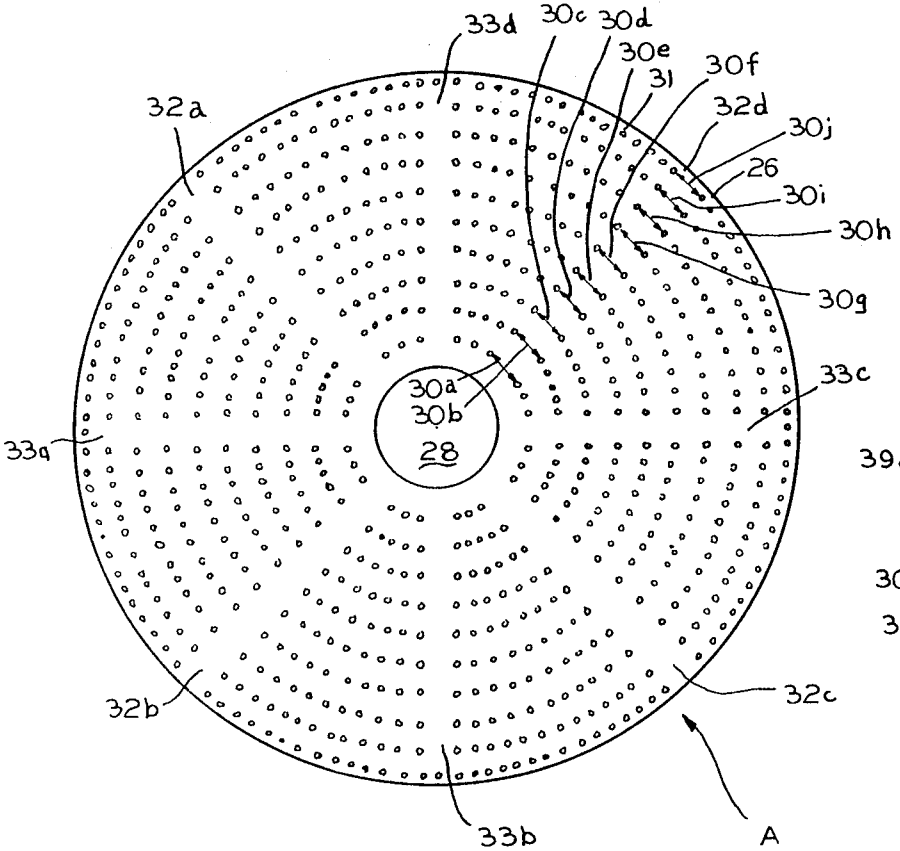
FIG. 3 illustrates an end orifice plate of the heat exchanger.

Referring to FIG. 3, each end orifice plate A comprises a circular plate 26. The plate 26 may be, for example, a lightweight material such as aluminum, approximately twenty-five to thirty thousandths of an inch thick. However, the plate 26 could be any high conductivity bondable material. A relatively large circular aperture 28 is provided through the plate 26 at its radial center. Surrounding the central opening 28 are ten (10) circular, concentric rows 30 of apertures 31. The ten rows are individually labelled with the suffix letter a–j. Each aperture 31 may be, for example, on the order of twenty-five thousandths of an inch in diameter. Each row 30 includes four first bridge sections 32*a–d* spaced ninety degrees apart having no such apertures 31. Also, with the exception of the radial outermost row 30*j*, each row 30*a–i* includes four second bridge sections 33*a–d* spaced ninety degrees apart having no such apertures. The second bridge sections 33*a–d* are positioned intermediate adjacent pairs of the first bridge sections 32*a–d*.

Figure 4:
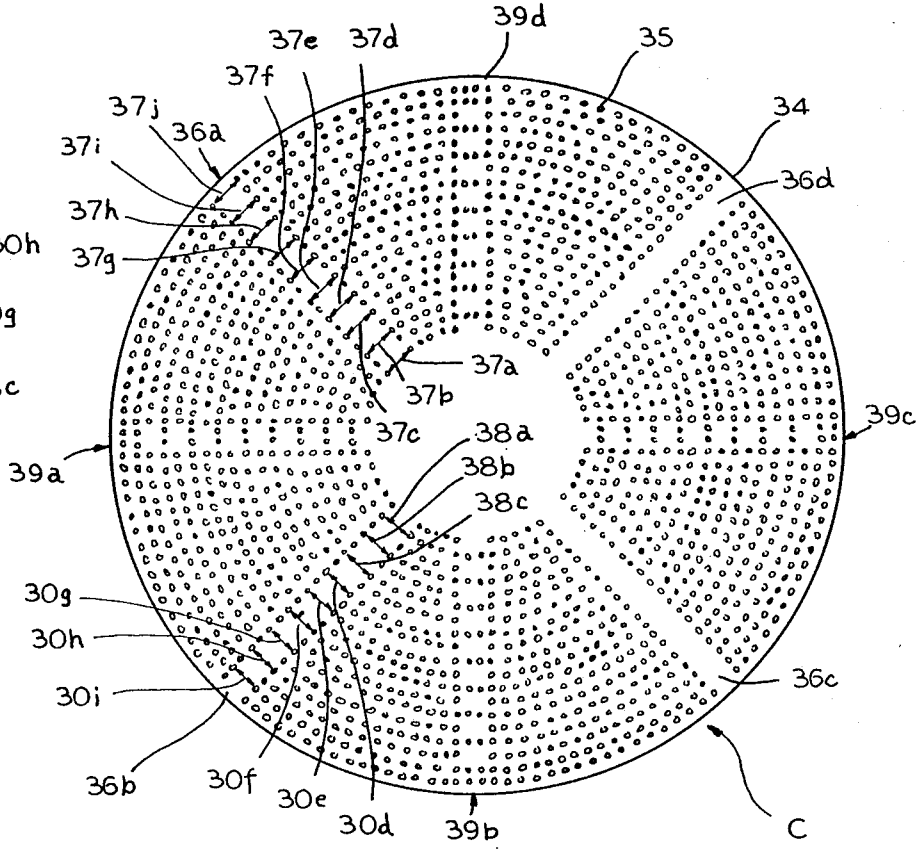
FIG. 4 illustrates an inner orifice plate of the heat exchanger.

Referring to FIG. 4, each inner orifice plate C comprises a circular plate 34 similar in size to the plates 26. The plate 34 may also be, for example, of aluminum. The plate 34 includes a plurality of apertures 35 of approximately twenty-five thousandths of an inch in diameter. The apertures 35 are arranged in circular, concentric rows. Specifically, a first set of rows 37*a–j* generally correspond to the respective rows 30*a–j* of the plate 26. Each row 37*a–j* includes first bridge sections 36*a–d*, corresponding to the bridge sections 32*a–d*, and alternating second bridge sections 39*a–d* corresponding to the bridge sections 33*a–d*. A second set of rows 38*a–i* of apperatures are alternately disposed between adjacent pairs of the first set rows 37*a–j*. For example, the row 38*a* is radially outwardly of the row 37*a* and radially inwardly of the row 37*b*. The rows 38*a–i* have no apertures 35 at the first bridge sections 36*a–d*, but do have apertures 35 across the second bridge sections 39*a–d*.

Figure 5:
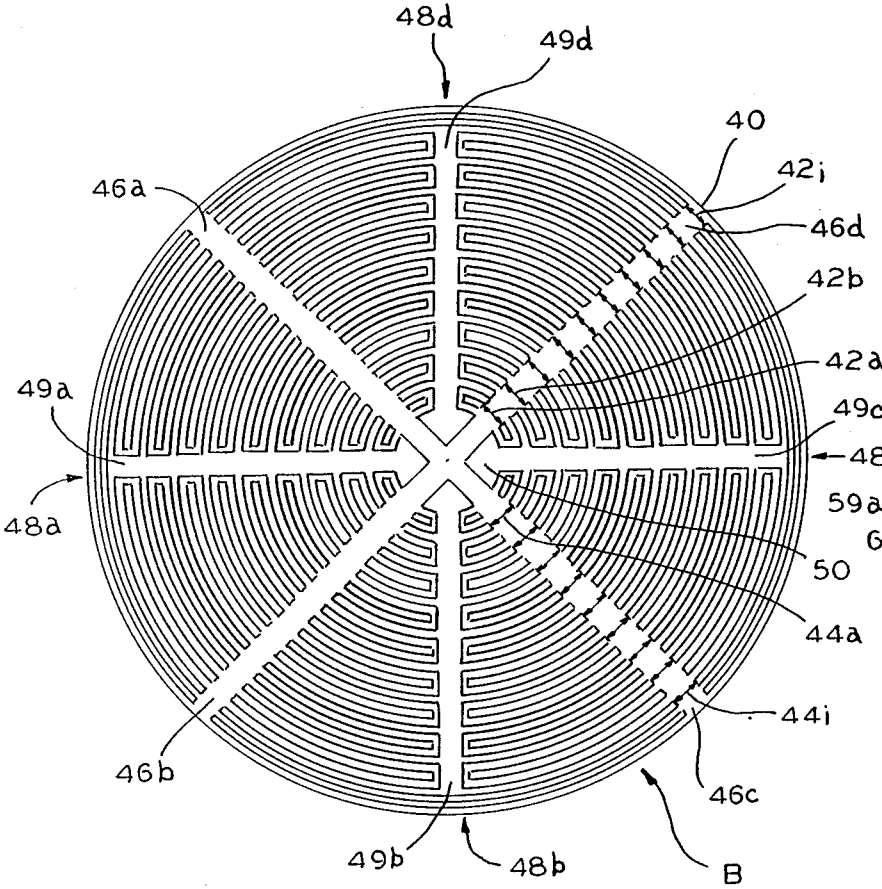
FIG. 5 illustrates an end spacer plate of the heat exchanger.

Referring to FIG. 5, each end spacer plate B is shown to comprise a plate 40 of generally circular construction. The plate 40 may be of aluminum construction on the order of fifty to sixty thousandths of an inch thick. The plate 40 includes a first set of concentric, circular discontinuous slots 42*a–j*. Specifically, each slot 42*a–j* is radially spaced a distance corresponding to the radial spacing between the rows of apertures 30*a–j* of the plate 26, see FIG. 3, and the rows of apertures 37*a–j* of the plate 34, see FIG. 4. The discontinuity of the slots 42*a–j* results from first bridge sections 46*a–d*, and second bridge sections 48*a–d*, as above with the plates 26 and 34. A second set of concentric, circular discontinuous slots 44*a–i* are also provided. Each of these slots 44*a–i* is disposed between adjacent pairs of the first set slots 42*a–j*. For example, the slot 44*a* is radially disposed between the slots 42*a* and 42*b*. The radial spacing between the second set slots 44*a–i* is similar to that with the second set of aperture rows 38*a–i* of the plate 34, see FIG. 4. The slots 44, are discontinuous at the first bridge sections 46*a–d*, but continue across the second bridge sections 48*a–d*. Specifically, each of the second bridge sections 48*a–d* includes a radially extending connecting slot 49*a–d* interconnecting the slots 44*a–i*. The connecting slots 49*a–d* interconnect at a circular central opening 50. The opening 50 is partially restricted by an X shaped member comprising the intersection of the first bridge sections 46*a–d*.

Figure 6:
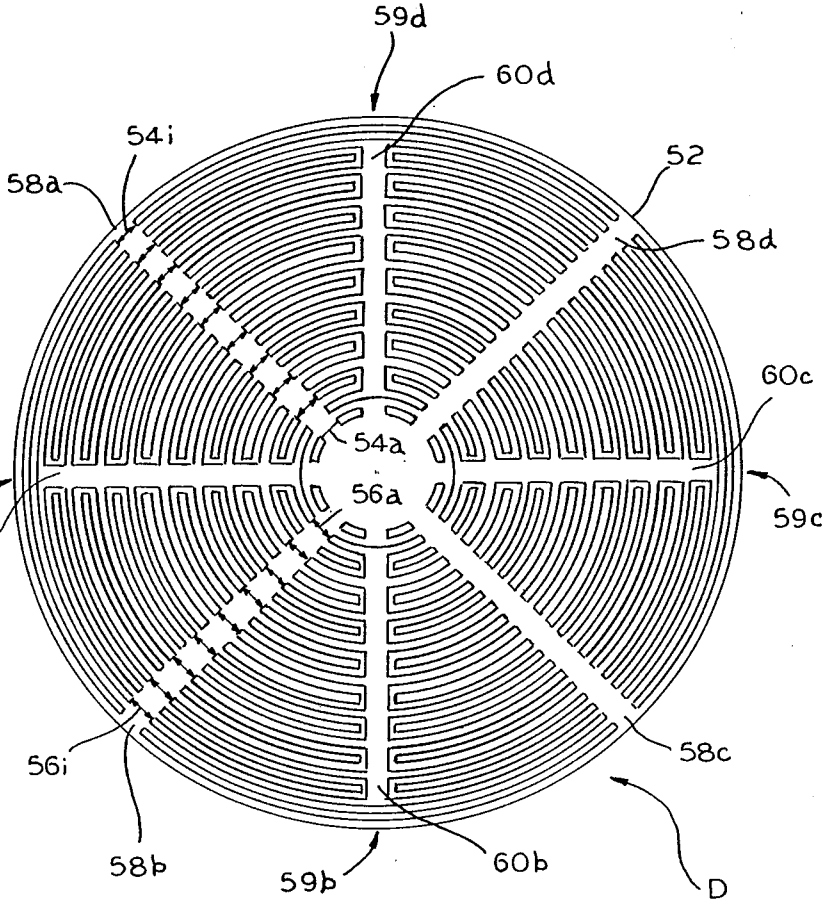
FIG. 6 illustrates an inner spacer plate of the heat exchanger.

Referring to FIG. 6, the inner spacer plates D each comprise a circular plate 52. The plate 52 may be, for example, of aluminum construction and is on the order of twenty-five to thirty thousandths of an inch thick. The plate 52 includes first and second sets of concentric, circular discontinuous slots 54*a–j* and 56*a–i* therethrough. The slots 54*a–j* and 56*a–i* are respectively similar to the slots 42*a–j* and 44*a–i* of the plate 40 and are therefore not discussed in detail. Also, the plate 52 includes first and second bridge portions 58*a–d* and 59*a–d*, similar to the respective bridge portions 46*a–d* and 48*a–d* of the plate 40. Radially extending connecting slots 60*a–d* extend across the second bridge sections 59*a–d* and connect the slots 56*a–i*. However, no central opening is provided in the plate 52.

The orifice plates 26 and 34 and the spacer plates 40 and 52 are arranged in a laminated arrangement, as discussed above, to form the stack 14, see FIG. 2. Specifically, the plates are angularly positioned so that the first bridge sections of each plate in the stack are in general alignment, as are the second bridge sections. For example, the first bridge sections 32*a* of the end orifice plates 26, 36*a* of the inner orifice plates 34, 46*a* of the end spacer plates 40, and 58*a* of the inner spacer plates 52 are in general angular alignment.

With the above-described construction, a first fluid path is provided through the aperture rows 30*a–j* of one end plate 26, through the slots 42*a–j* of one end spacer plate 40, alternately through the rows 37*a–j* of the inner orifice plates 34 and the slots 54*a–j* of the inner spacer plates 52, through the slots 42*a–j* of the other end spacer plate 40 and the aperture rows 30*a–j* of the other end orifice plate. In fact, this first fluid path defines the fluid path for the high pressure fluid. A second fluid path is provided by the connection of the central aperture 50 of the end spacer plates 40 through the connecting slots 49*a–d* to the slots 44*a–i*, and alternately through the aperature rows 38*a–i* of the inner orifice plates 34 and the slots 56*a–i* of the inner spacer plates 52. The second fluid path defines a fluid path for the low pressure fluid.

Owing to the thermal conductivity of the plates 26, 34, 40 and 52, heat is transferred between a fluid flowing through the first fluid path and a fluid flowing through the second fluid path.

To enhance heat transfer, successive adjacent orifice plates 26 and 34 may be slightly, angularly offset to provide jet impingement of fluid on each subsequent plate. This is accomplished by rotating successive plates 26 and 34 as indicated by the angular offset of a position marker 62 provided on each plate 26 and 34, see FIG. 2. Alternatively, each plate could be provided with an alignment tab, as is well known, to align each plate using conventional alignment pins and provide for the desired angular relationship.

Each of the shell halves 12*a* and 12*b* includes a respective circular shoulder 62*a* and 62*b*. The shoulders 62*a* and 62*b* are axially spaced a distance similar to the height of the stack 14. Accordingly, the stack 14 is held in position within the shell 12, between the shoulders 62*a* and 62*b*.

The plates in the stack 14 are bonded together. Specifically, each spacer plate 40 or 52 is bonded to the pair of orifice plates 26 or 34 adjacent thereto. Such bonding may be provided, for example, as by brazing adjacent plates. Alternatively, if the plates are copper plates, diffusion bonding could be used, as is well known.

The low pressure inlet port 20 comprises a central opening 64 through the first shell half 12*a*. A cylindrical conduit 66 extends between the opening 64 and the opening 28 of one end orifice plate A. The conduit 66 is bonded to the end plate A in a conventional manner, and an O-ring 68 provides a seal between the opening 64 and the conduit 66. The low pressure outlet port 22 comprises a similar central opening 70 through the shell second half 12*b*. A second cylindrical conduit 72 extends between the opening 70 and the adjacent end orifice plate A. The conduit 72 is bonded to the orifice plate A, as above. A similar O-ring 74 provides a seal between the conduit 72 and the opening 70.

The high pressure inlet 16 comprises a second opening 76 through the first shell half 12*a*. Similarly, the high pressure outlet port 18 comprises an opening 78 through a neck extending from the shell second half 12*b*.

Although not specifically illustrated, each shell opening 64, 70, 76 and 78 is provided with any conventional means for connecting to external fluid conduits, such as hoses or the like.

In application, with suitable connections provided to a high pressure fluid source at ports 16 and 18, and a low pressure fluid source at ports 20 and 22, the low pressure fluid passes through the inlet port conduit 66 and flows through the central aperture 28 in the first end orifice plate A. The flow is then distributed through the stack second fluid path via the central opening 50 of the first end spacer plate B. The low pressure fluid is subsequently collected at the central opening 50 of the second end spacer plate B and the central opening 28 of the second end orifice plate A and exits the heat exchanger 10 through the conduit 72 to the outlet port 22.

The high pressure fluid enters the high pressure inlet port 16 and is distributed among the apertures 31 in the first end orifice plate A. Fluid is subsequently distributed through the stack first fluid path. The high pressure fluid exits the stack through the opposite end orifice plate A and exits the shell through the neck 80 and the high pressure outlet port 18.

Owing to the construction of the high strength pressure shell 12 and the described seal, the high pressure inside the shell 12, provided by the high pressure fluid, places the laminated stack 14 in compression to aid the existing bonds in holding the stack 14 together. Particularly, the high pressure fluid exerts a compressive force at each of the end orifice plates A. An oppositely acting or reverse force is evident internally to the stack 14 due to the jet impingement forces. However, this reverse force is cancelled by the compressive force. Also, the compressive force is across the entire face of the end plates A, while the magnitude of the reverse force varies between that provide by the high pressure fluid and that provided by the low pressure fluid. Therefore, there is a slight net compressive force because of the lower reverse force provided along the circular areas defined by the lower pressure fluid path.

Although the heat exchanger 10 disclosed herein is of cylindrical construction, the present invention might be employed in applications where other constructions are utilized. Also, variations of the heat exchanger stack, including the number of plates, the size and number of orifices or slots, could be varied as necessary or desired. In fact, the orifice plates could be provided with orifice slots rather than circular apertures, as is well known.

Thus, the invention broadly comprehends a small, relatively lightweight inexpensive high pressure sealed fluid-to-fluid heat exchanger.

We claim:

1. A heat exchanger comprising:

a plurality of orifice plates each having a plurality of apertures therethrough;

a plurality of spacer plates each having first and second sets of apertures therethrough, each said spacer plate being positioned between adjacent ones of said orifice plates;

means for bonding each of said spacer plates to adjacent ones of said orifice plates with said first and second sets of apertures generally in alignment with selected ones of said orifice plate apertures to provide respective first and second fluid paths, and defining a heat exchanger stack;

conduits means in fluid communication with said stack for providing fluid flow through said second fluid path; and means, including a shell housing said stack and having inlet and outlet means, for providing flow of pressurized fluid through said first fluid path and for causing said fluid to exert a compressive force on said stack to aid said bonding means.

2. The heat exchanger of claim 1 wherein the apertures of successive orifice plates are slightly angularly offset to provide jet impingement of fluid in each fluid path.

3. The heat exchanger of claim 1 wherein said conduit means comprises a fluid conduit extending between said stack and openings provided in said shell.

4. A high pressure laminated heat exchanger comprising:

a laminated stack including a plurality of heat conductive orifice plates each having a plurality of apertures therethrough, a plurality of spacer plates each having first and second sets of apertures therethrough, each said spacer plate being positioned between adjacent ones of said orifice plates, means for bonding each of said spacer plates with adjacent ones of said orifice plates with said first and second sets of apertures generally in a preselected alignment with selected ones of said orifice plate apertures to provide respective first and second fluid paths, the outermost of said spacer plates also having an inlet aperture therethrough in fluid communication with said second set of apertures, the apertures of the outermost of said orifice plates being in alignment only with said spacer plate first set of apertures;

fluid conduit means in fluid communication with said inlet aperture for providing fluid flow through said second fluid path; and means, including a high pressure shell housing said stack and having inlet and outlet means, for providing flow of pressurized fluid through said first fluid path and for causing said pressurized fluid to exert a compressive force on said stack to aid said bonding means.

5. The heat exchanger of claim 4 wherein the outermost of said spacer plates are of a larger thickness then the other of said spacer plates.

6. The heat exchanger of claim 4 wherein said shell includes first and second openings defining a high pressure inlet and outlet port, and third and fourth openings, wherein said fluid conduit means comprises first and second fluid conduits disposed between said third and fourth openings and said laminated stack.

7. The heat exchanger of claim 4 wherein said orifice plates and spacer plates are of aluminum construction and said bonding means comprises a brazed bond therebetween.

8. A pressure sealed, laminated heat exchanger comprising:

a plurality of first heat conductive orifice plates each having a plurality of apertures therethrough;

a plurality of first spacer plates each having first and second sets of apertures therethrough, each said spacer plate being positioned between adjacent ones of said orifice plates and defining a stack having said sets of apertures generally in alignment with selected ones of said first orifice plate apertures to provide first and second fluid paths;

a pair of end spacer plates outwardly of said stack and having a first and second sets of apertures therethrough corresponding to said first spacer plate first and second sets of apertures, and an inlet aperture therethrough in fluid communication with said second set of apertures;

a pair of end orifice plates outwardly of said end spacer plates and having a plurality of apertures therethrough generally in alignment with said end spacer plate first set of apertures;

means for bonding each of said spacer plates to adjacent ones of said orifice plates;

first and second fluid conduits each in fluid communication with the inlet aperture of one of said end spacer plates so that fluid entering said first fluid conduit passes through said second fluid path and exits through said second conduit; and a high pressure shell housing said bonded plates and having inlet and outlet ports so that high pressure fluid entering said inlet port passes through said first fluid path and exits through said outlet port and also exerts a compressive force on said end orifice plates to aid said bonding means.

9. The heat exchanger of claim 8 wherein said shell includes low pressure inlet and outlet port openings and said first and second fluid conduits are sealingly engaged to said low pressure inlet and outlet port openings.

* * * * *